US005309652A

United States Patent [19]

Campbell

[11] Patent Number: 5,309,652

[45] Date of Patent: May 10, 1994

[54] SNOW SHOE KIT

[76] Inventor: Lawrence W. Campbell, 28 Highview Dr., Utica, N.Y. 13502

[21] Appl. No.: 55,284

[22] Filed: May 3, 1993

[51] Int. Cl.[5] ..... A43B 5/04; A63C 1/02

[52] U.S. Cl. ..... 36/124; 36/122

[58] Field of Search ..... 36/116, 122, 123, 124, 36/125; 12/142 R, 142 P; 36/97, 99, 112, 100, 101; 280/11.16

[56] References Cited

U.S. PATENT DOCUMENTS

| | | | |
|---|---|---|---|
| 3,225,462 | 12/1965 | Lamberti | 36/100 |
| 3,555,707 | 1/1971 | Sharratt et al. | 36/123 |
| 3,636,643 | 1/1972 | Lundquist | 36/125 |
| 3,760,513 | 9/1973 | Corneliusen | 36/124 |
| 4,041,621 | 8/1977 | Anderson | 36/122 |
| 4,161,071 | 7/1979 | Maul | 36/125 |
| 4,348,823 | 9/1982 | Knapp et al. | 36/123 |
| 4,720,927 | 1/1988 | Abegg | 36/125 |
| 5,014,450 | 5/1991 | McGrath | 36/124 |

*Primary Examiner*—Steven N. Meyers
*Attorney, Agent, or Firm*—Leon Gilden

[57] ABSTRACT

A base frame is arranged to securably mount one of a plurality of tail frames, as well as one of a plurality of corresponding head frames, to permit the snow shoes to accommodate various terrains and conditions of snow. In this manner, an individual snow shoe construction is adapted to accommodate various terrain and snow fall.

3 Claims, 4 Drawing Sheets

SNOW SHOE KIT

BACKGROUND OF THE INVENTION

1. Field of the Invention

The field of invention relates to snow shoe apparatus, and more particularly pertains to a new and improved snow shoe kit wherein the snow shoe kit includes interchangeable head and base webs to provide for reconfiguration of the associated snow shoe structure.

2. Description of the Prior Art

Snow shoe apparatus of various types are available in the prior art such as indicated in the U.S. Pat. Nos. 4,348,823; 4,213,256; and 3,555,708.

The instant invention attempts to overcome deficiencies of the prior art by permitting an individual base snow shoe frame to receive various configurations and lengths of tail and head frame portions relative to the base frame to permit accommodation of various snow conditions and in this respect, the present invention substantially fulfills this need.

SUMMARY OF THE INVENTION

In view of the foregoing disadvantages inherent in the known types of snow shoe structure now present in the prior art, the present invention provides a snow shoe kit wherein the same includes interchangeable head and tail frame portions relative to a base frame. As such, the general purpose of the present invention, which will be described subsequently in greater detail, is to provide a new and improved snow shoe kit which has all the advantages of the prior art snow shoe apparatus and none of the disadvantages.

To attain this, the present invention provides a base frame arranged to securably mount one of a plurality of tail frames, as well as one of a plurality of corresponding head frames, to permit the snow shoes to accommodate various terrains and conditions of snow. In this manner, an individual snow shoe construction is adapted to accommodate various terrain and snow fall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved snow shoe kit which has all the advantages of the prior art snow shoe apparatus and none of the disadvantages.

It is another object of the present invention to provide a new and improved snow shoe kit which may be easily and efficiently manufactured and marketed.

It is a further object of the present invention to provide a new and improved snow shoe kit which is of a durable and reliable construction.

An even further object of the present invention is to provide a new and improved snow shoe kit which is susceptible of a low cost of manufacture with regard to both materials and labor, and which accordingly is then susceptible of low prices of sale to the consuming public, thereby making such snow shoe kits economically available to the buying public.

Still yet another object of the present invention is to provide a new and improved snow shoe kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
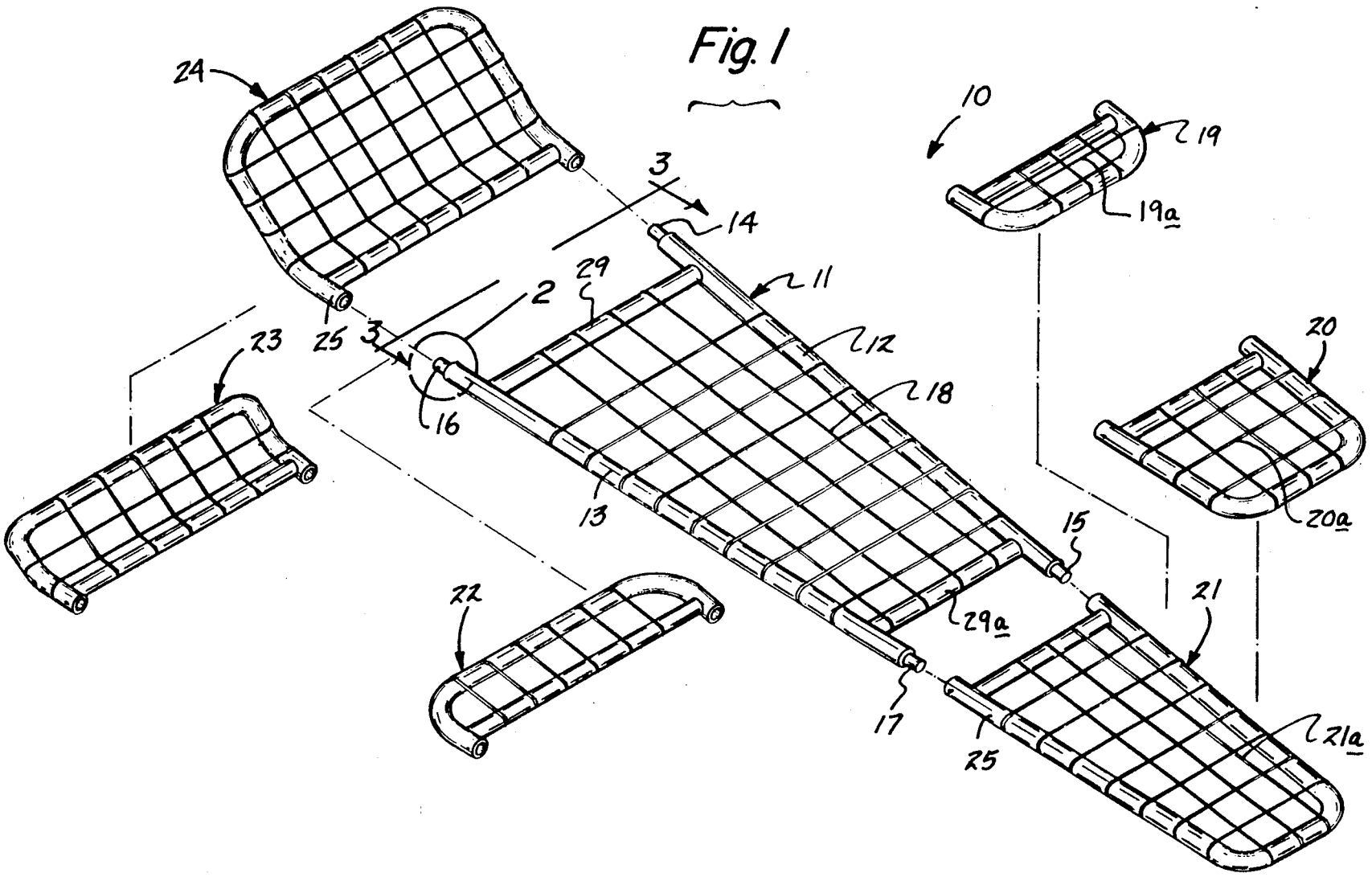
FIG. 1 is an isometric illustration indicating the base frame arranged to accommodate the sub-assemblies of tail frame and head frame portions.
Figure 2:
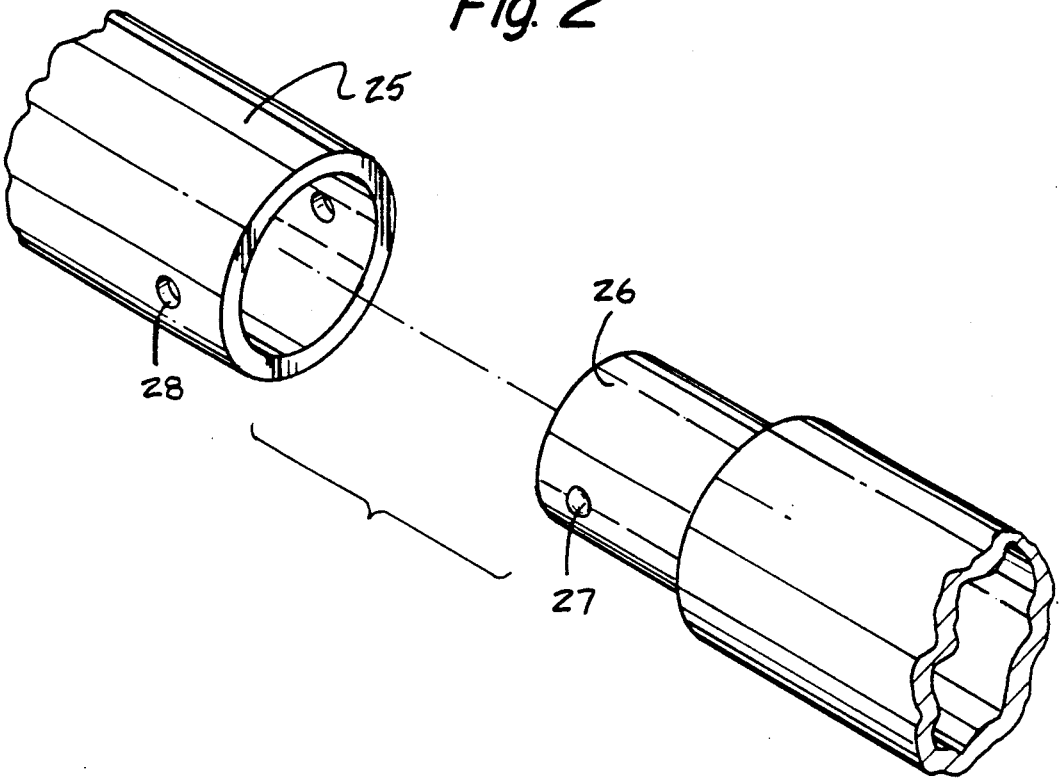
FIG. 2 is an isometric illustration of section 2 as set forth in FIG. 1.

With reference now to the drawings, and in particular to FIGS. 1 to 7 thereof, a new and improved snow shoe kit embodying the principles and concepts of the present invention and generally designated by the reference numeral 10 will be described.

More specifically, the snow shoe kit 10 of the instant invention essentially comprises a trapezoidal base frame 11, having a first leg 12 coplanar with the second leg 13 of the base frame 11, to include respective base frame head and base legs 29 and 29*a* parallel relative to one another. The base frame first leg 12 includes a first leg first end 14 spaced from first leg second end 15, with the second leg 13 having second leg first and second ends 16 and 17 respectively that extend beyond the adjacent head and base legs 29 and 29*a*. The base frame 11 is arranged to receive a base web 18 coextensively therewith, wherein respective first, second, and third head frames 22, 23, and 24 are provided. The first head frame 22 is arranged to include a first length, with the second head frame 23 of an L-shaped second length greater than the first length, and the third head frame 24 of a further third length also of an L-shaped configuration, wherein the third length is greater than the second length. Respective first, second, and third tail frames 19, 20, and 21 are provided, wherein the first tail frame 19 is of a first tail frame length having a tail frame first web 19*a*, wherein the second tail frame 20 of a second length greater than said first length is of a second web length greater than said first web length, with a second web 28 directed within the second tail frame 20. A third tail frame 21 of a third tail frame length greater than said second tail frame length is provided, having a third web 21*a* therewithin. The respective first, second, and third tail frames 19, 20, and 21 are arranged for selective securement to the respective first and second leg second ends 15 and 17 respectively, wherein the first and second leg first ends 14 and 16 are arranged for selective securement to one of the head frames 22, 23, or 24. It should be noted that the head frames are also provided with respective head frame webs, as illustrated.

The use of the first tail frame and associated first head frame is arranged for climbing in typically deep snow conditions along hillsides, wherein the second tail and head frames are arranged for deep snow in typically woody terrain. The third tail frame and head frame portions are arranged for deep snow in open country accommodating various snow drifts and the like. In this manner, the organization is arranged to accommodate various terrain and snow conditions.

Figure 3:
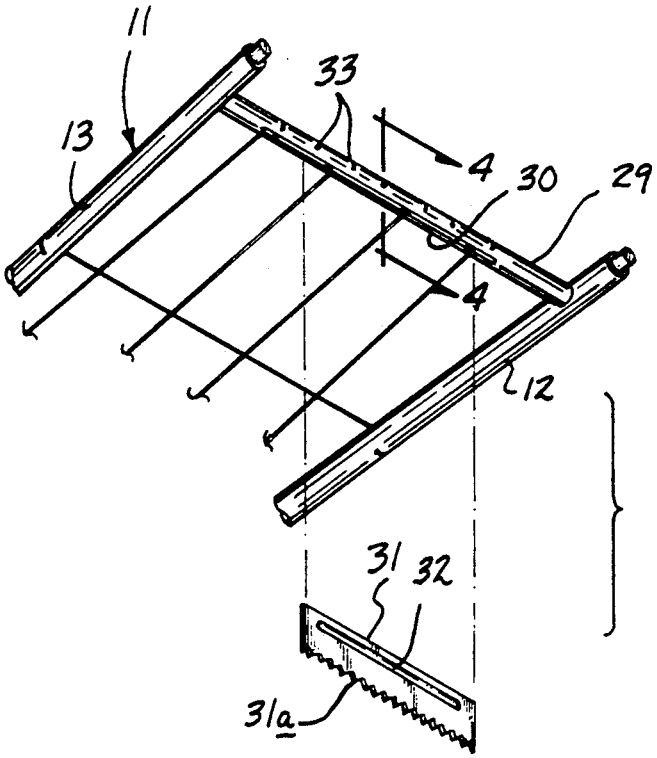
FIG. 3 is an isometric illustration of section 3 as indicated in FIG. 1.

Securement of the selection of tail and head frame structure, as indicated in FIG. 1, in association with the first and second ends of the first and second legs 12 and 13 is accommodated, in a manner as exemplified in FIG. 3, employing a projecting leg 26 of an associated leg portion of the first and second legs 12 and 13 arranged for reception within a receiving tube 25. The receiving tube is arranged relative to a head or tail frame structure, as exemplified in FIG. 1, with the receiving tube having receiving tube locking bores 28 to receive locking spheres 27 of the projecting leg 26.

Figure 4:
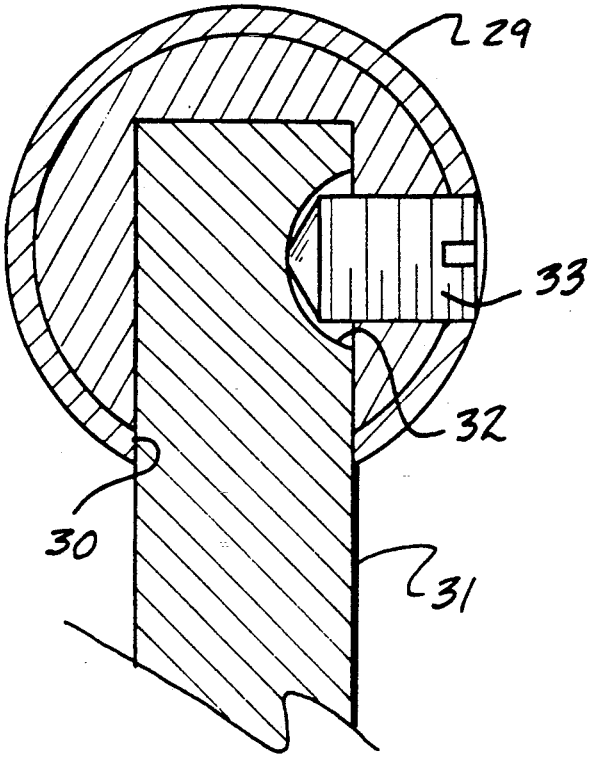
FIG. 4 is an orthographic view, taken along the lines 4—4 of FIG. 3 in the direction indicated by the arrows.

The base frame head leg 29 is indicated in the FIGS. 1 and 3 and arranged with the leg slot 30 intermediate the first and second legs 12 and 13 to receive a cleat plate 31 having a saw-toothed exposed edge 31*a*. The cleat plate includes a cleat plate groove 32, wherein fasteners 33 threadedly directed through the head leg 29 is received within the cleat plate groove 32, as indicated in FIG. 4.

Figure 5:
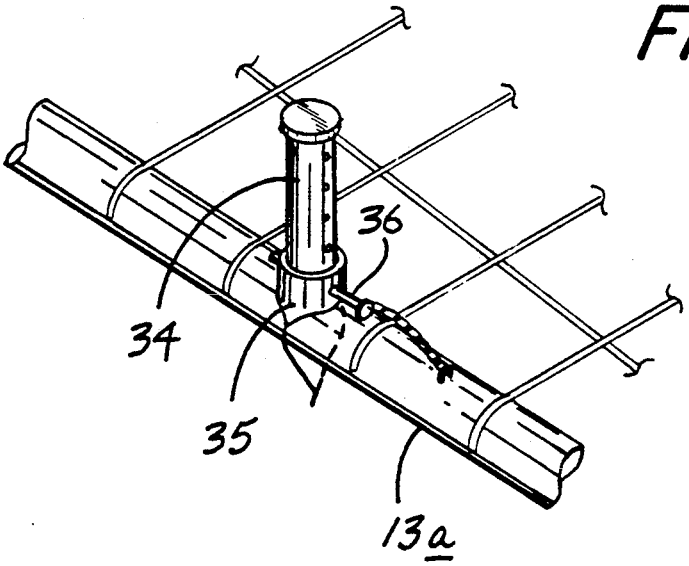
FIG. 5 is an isometric illustration of a modified leg portion of the base frame.

Further, as indicated in FIG. 5, a modified second leg portion 13*a*, as well as a modified first leg portion, is arranged to include a receiving tube 35 slidably directed with a spike rod 34 orthogonally relative to the associated first or second leg 13*a* or 12*a*, with the receiving tube and the spike rod arranged to accommodate a lock pin 36 therethrough to position the lock pin structure 36 as desired.

Figure 6:
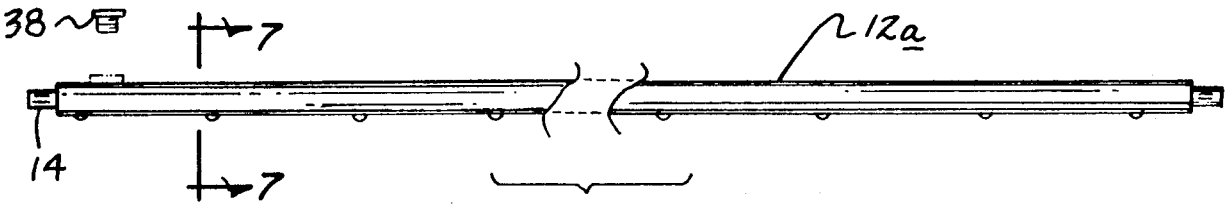
FIG. 6 is a modified leg structure of the base frame.
Figure 7:
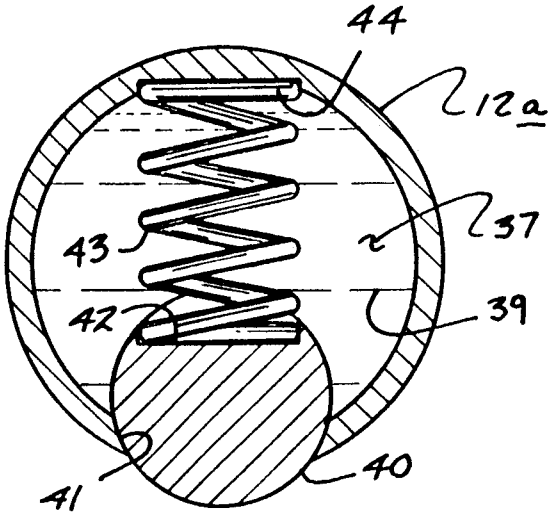
FIG. 7 is an orthographic view, taken along the lines 7—7 of FIG. 6 in the direction indicated by the arrows.

Alternatively, the FIGS. 6 and 7 indicate an optional structure for use with the organization, wherein a modified first leg 12*a* is arranged to have a first leg reservoir cavity 37, including a reservoir cap 38 removably mounted relative to the reservoir cavity 37 to permit filling of a fluid dye 39 within the reservoir cavity 37. A plurality of valve spheres 40 having a predetermined diameter are received within a valve sphere opening 41, having a valve sphere opening less than said predetermined diameter to capture an individual valve sphere 40 within the cavity 37. The valve sphere includes a valve sphere recess 42 spaced from a spring recess 44 within the associated modified first leg to capture a spring 43 therewithin to bias the associated valve sphere 40 within the valve sphere opening 41. In this manner in use of the organization, as the valve spheres 40 are displaced relative to an associated opening, the dye is directed therethrough to provide for a trail for an individual following to visually observe to function as a trail marker in snow conditions.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A snow shoe kit, comprising, a base frame, the base frame including a head leg spaced from and parallel a base leg, and the frame further having a first leg spaced from a second leg, with the first leg and the second leg integrally mounted to the head leg and the base leg, with a base web mounted coextensively within the first leg, second leg, base leg, and head leg, and a first tail frame and a second tail frame arranged for securement at a first end of the base frame, and at least a first head frame and a second head frame, wherein an individual of said first head frame and said second head frame is arranged for securement to the base frame at a second end of the base frame, and the first tail frame is of a first length, the second tail frame is of a second length, wherein the second length is greater than said first length, and the first head frame having a first head frame length, the second head frame having a second head frame length, wherein the second head frame length is greater than said first head frame length, and the second head frame is of an L-shaped configuration, and locking means for securement of each of said first tail frame, said second tail frame, said first head frame, and said second head frame to said base frame, and the head leg includes a head leg slot oriented intermediate the first leg and the second leg, and a rigid cleat plate, the cleat plate uppermost end is arranged for reception within the slot, and the cleat plate lowermost end includes an engaging surface, wherein the cleat plate further includes a cleat plate groove arranged for positioning within the slot, and the head leg includes a plurality of fasteners directed through the head leg and received within the groove.

2. A snow shoe kit as set forth in claim 1 wherein at least said first leg includes a first leg tube, and a spike rod directed through said tube, with a lock pin arranged for reception through the tube and the spike rod for securement of the spike rod within the tube.

3. A snow shoe kit as set forth in claim 2 including the second leg having a reservoir cavity, and a fill cap arranged for replenishment of fluid within said reservoir cavity, and at least one opening directed within the second leg, and the second leg including a valve sphere positioned within the cavity in biased communication with the opening, with a spring in communication with the valve sphere for biasing the valve sphere into the opening, the opening having an opening diameter, the valve sphere having a valve sphere diameter, wherein the valve sphere diameter is greater than said opening diameter.

* * * * *